United States Patent [19]

van den Broek

[11] 3,986,310

[45] Oct. 19, 1976

[54] MODULAR SWIMMING POOL STRUCTURE AND METHOD FOR ITS ERECTION

[75] Inventor: William A. van den Broek, Doylestown, Pa.

[73] Assignee: KDI Sylvan Pools, Inc., Doylestown, Pa.

[22] Filed: Dec. 18, 1974

[21] Appl. No.: 534,125

Related U.S. Application Data

[63] Continuation of Ser. No. 80,037, Oct. 12, 1970, abandoned, which is a continuation-in-part of Ser. No. 731,573, May 23, 1968, Pat. No. 3,584,319.

[52] U.S. Cl. ..... 52/169 R; 52/588; 52/300; 4/172.19

[51] Int. Cl.[2] ..... E04H 3/16; E04H 3/18

[58] Field of Search ..... 52/169, 300, 578, 579, 52/127, 588; 4/172.19, 172.21; 61/60

[56] References Cited

UNITED STATES PATENTS

| | | | |
|---|---|---|---|
| 1,437,044 | 11/1922 | Cushing | 61/60 |
| 1,896,259 | 2/1933 | Thackray | 52/579 |
| 1,963,980 | 6/1934 | Garrett | 52/127 |
| 2,354,485 | 7/1944 | Slaughter | 52/578 |
| 2,861,277 | 11/1958 | Hermann | 61/60 |
| 3,031,801 | 5/1962 | Leuthesser | 52/169 |
| 3,100,556 | 8/1963 | De Ridder | 4/172 |
| 3,186,525 | 6/1965 | Gresham et al. | 52/620 |
| 3,274,621 | 9/1966 | Diemond et al. | 4/172.19 |
| 3,280,408 | 10/1966 | Gershman | 4/172.19 |
| 3,427,663 | 2/1969 | O'Connell et al. | 4/172.21 |
| 3,440,780 | 4/1969 | Adam et al. | 4/172.19 |

FOREIGN PATENTS OR APPLICATIONS

| | | | |
|---|---|---|---|
| 294,441 | 1/1966 | Australia | 4/172.21 |
| 1,309,112 | 10/1962 | France | 52/300 |

*Primary Examiner*—James L. Ridgill, Jr.
*Attorney, Agent, or Firm*—Sughrue, Rothwell, Mion, Zinn and Macpeak

[57] ABSTRACT

A modular swimming pool structure, for pools of the type having a water impermeable liner received in a cavity, utilizes a minimum of repeated components which permit the structure to be installed in-ground or above-ground in a wide variety of shapes and configurations. The cavity walls are defined by a plurality of positively interlocked metal boards which are articulatable with respect to each other and can thus be used for linear or arcuate pool configurations. The tops of the boards are received in a coping beam and the bottoms in a ground beam, variants of each being disclosed. The same boards may be used for a perimetrical decking, of particular benefit in the case of above-ground pools. An erection method for an in-ground pool is also disclosed which minimizes the excavation required. Above-ground versions with decks provide integral buttressing and all versions avoid conventional bracing structures.

11 Claims, 9 Drawing Figures

Fig. 1
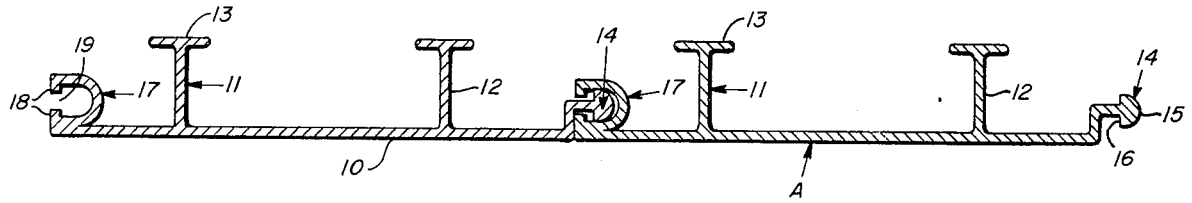
Fig. 2
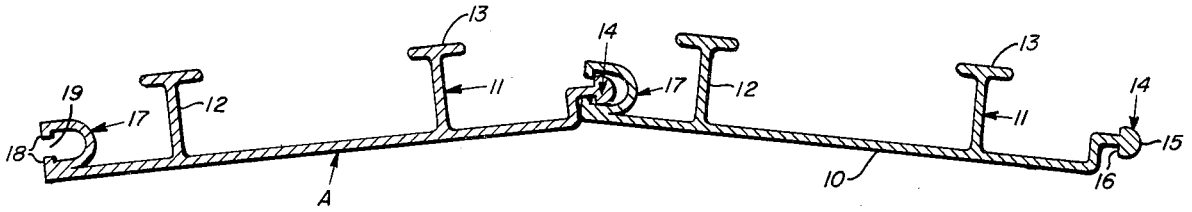
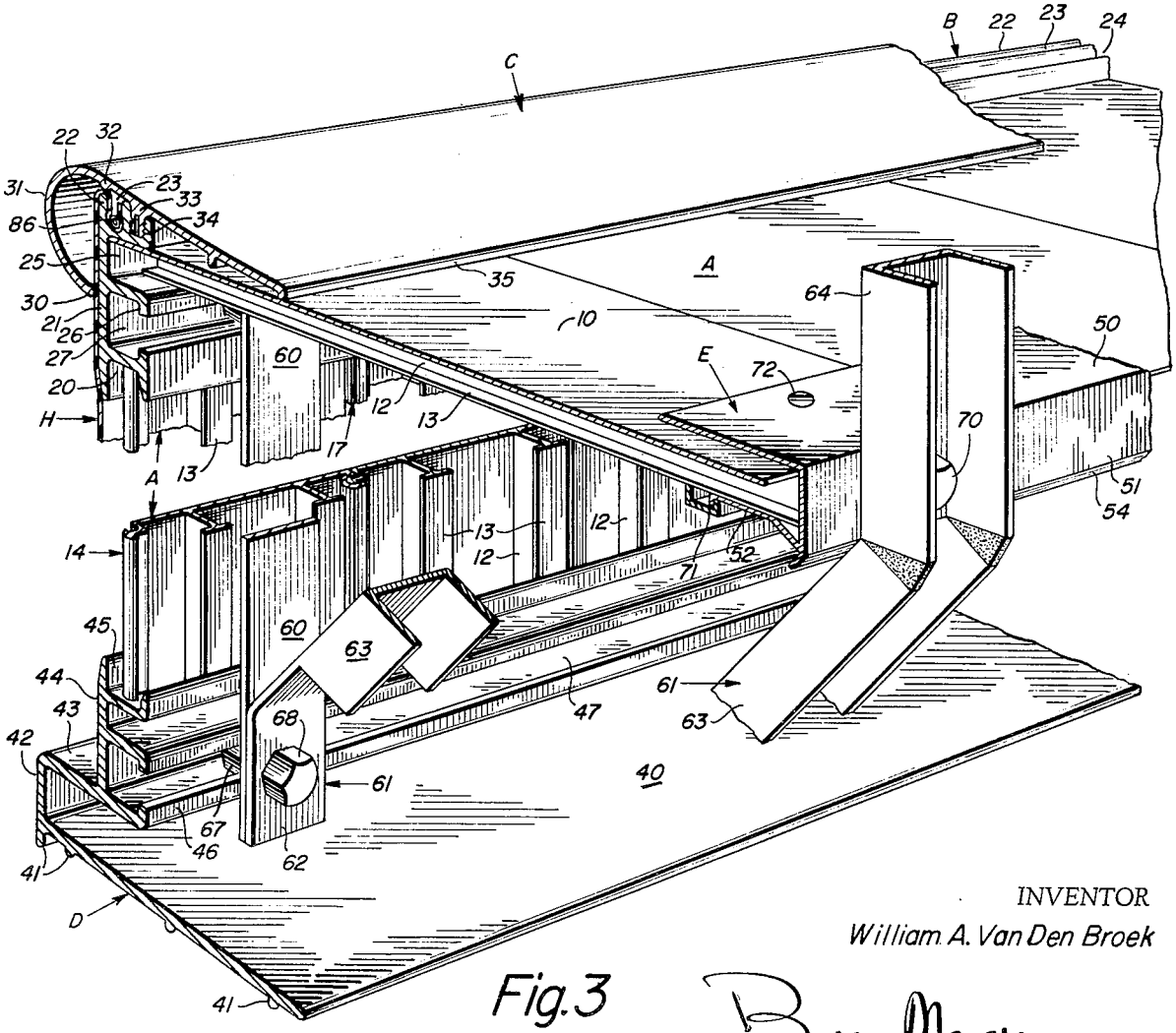
Fig. 3
INVENTOR
William A. Van Den Broek
BY Barry Moyerman.
ATTORNEY INVENTOR
William A. Van Den Broek BY Barry Moyerman.

ATTORNEY

INVENTOR
William A. Van Den Broek

BY Barry Mayerman.

ATTORNEY

INVENTOR
William A. Van Den Broek

BY Barry Moyerman.
ATTORNEY

INVENTOR
William A. Van Den Broek

BY Barry Mayerson.

ATTORNEY

MODULAR SWIMMING POOL STRUCTURE AND METHOD FOR ITS ERECTION

CROSS-REFERENCE TO RELATED APPLICATION

This application is a continuation of Ser. No. 80,037 filed Oct. 12, 1970, now abandoned, which was a continuation-in-part of SN 731,573 filed May 23, 1968, now U.S. Pat. 3,584,319 issued June 15, 1971.

BACKGROUND OF THE INVENTION

1. Field of the Invention

This invention relates to modular swimming pool structures More particularly, it relates to cavity-defining pool structures which are used with a water impermeable liner and which may installed either in-ground or above-ground.

2. Prior Art

The prior art in this field is legion and it would be indeed presumptuous to attempt an objective evaluation thereof herein. There is, of course, a large body or art with respect to permanent in-ground pools of concrete construction which is of only peripheral interest. The relevant prior art has to do with above-ground and in-ground pools made of metallic structural components which have as their object the provision of a cavity to receive and support a water impermeable liner. The art has moved in this direction out of a desire to avoid the labor and expense inherent in erection of concrete pools. Use of prefabricated sub-assemblies and assemblies permits quick and easy erection in the field by relatively unskilled labor.

However, there is, regardless of construction, the need to offer the consumer a variety of choices. These extend not only to obvious parameters like pool dimensions but also to the shape of the pool and to basic variables like whether the pool is to be above-ground or in-ground. Attemps have therefore been made to design modular structures wherein the same elements can be used over and over again regardless of the ultimate nature of the pool desired.

Prior art approaches are exemplified by Adam et al. U.S. Pat. No. 3,440,780; Lerner U.S. Pat. No. 3,016,546; Diemond et al U.S. Pat. No. 3,274,621; and the other patents cited in connection with the parent application, referred to above, which patents are incorporated herein by reference.

Examination of these references reveals that there has been no universal system disclosed good for above-ground or in-ground pools; for linear or arcuate configurations; for pools with integral decks and without integral decks. Further, the bracing and buttressing necessary to resist the forces caused by the water in the pool (as exemplified in Pereira U.S. Pat. No. 3,416,165) is painfully obvious and necessitates the use of many extra support members. But most of all, there has been a minimal attempt at economy by the use of repetitive extrusions so that the same extrusion, for example, can be used for vertical wall boards and for deck boards for a ground bearing member and for a coping member and in other such interchangeable paired relationships.

SUMMARY OF THE INVENTION

Swimming pools, which may be in-ground or above-ground, arcuate or linear in perimeter and with or without integral perimetrical decks may be constructed from repetitive modules. A module basic to all of these variations is a positively interlocked metal wall board having a male tongue and a female groove which can be mated only by sliding insertion. Once inserted, the locked boards can articulate — thus providing arcuate pool cavities or linear cavities. These same boards (i.e. the same extrusion) can be used for decking material in those pools provided with decks. The tops of the boards are received and retained in a coping beam and the bottoms of the boards may be received and retained in a ground beam. Ground beam and coping beam embodiments are disclosed which utilize the same extrusion and thus afford economies of construction. Reinforcement is provided in a variety of ways.

In those embodiments having an intergral deck, repetitive triangulation is used with the wall and deck forming two legs of a triangle and a simple brace supplying the third leg. In such embodiments, the ground beam is a vertex of the triangle, the coping beam is a second vertex and an end cap beam, which receives one end of the decking and one end of the brace, constitutes the third vertex.

In those in-ground embodiments which do not have integral decks, channels which span vertically from ceping beam to ground beam, and which are positioned behind the pool walls, supply the necessary rigidity.

During assembly of in-ground pools, the pool walls are kept plumb in the excavated cavity by a plurality of cantilevered arms which link the tops of the boards and the unexcavated ground. No bracing being needed for this purpose, the size of the excavation can be minimal and costs of excavation and backfilling thereby reduced.

Accordingly, it is an object of the invention to provide components of a pool structure which can be used for above-ground pools or for in-ground pools, which are interchangeable to a maximum extent, which give a structure strong enough to resist the force of water without the use of A-frames and the like, which are economical to fabricate and which can be erected quickly with a minimum of skilled labor.

It is a further object of the invention to provide a method for in-ground installation of a pool of the type described which minimizes the amount of excavation and backfilling required.

These and other objects of the invention will be apparent to those skilled in the art from a consideration of the description which follows of exemplary embodiments of the invention. Neither that description, nor the abstract and summary above, are intended to limit or otherwise restrict the scope of the invention. The abstract and summary have been inserted solely as tools for reader orientation and for information retrieval.

BRIEF DESCRIPTION OF THE DRAWINGS

In the drawings, wherein like reference letters and numerals designate, respectively, like assemblies and like parts:

FIG. 1 represents a plan view of two vertical wall boards of the invention as they would appear joined to form the sides of a generally rectangular swimming pool.

FIG. 2 represents a plan view of the same vertical boards as they would appear, fully articulated, in a pool having an arcuate perimetrical wall.

FIG. 3 represents a fragmentary perspective view of an above-ground swimming pool having an extended integral deck and a bottom ground-bearing beam.

DESCRIPTION OF THE PREFERRED EMBODIMENTS

Figure 4:
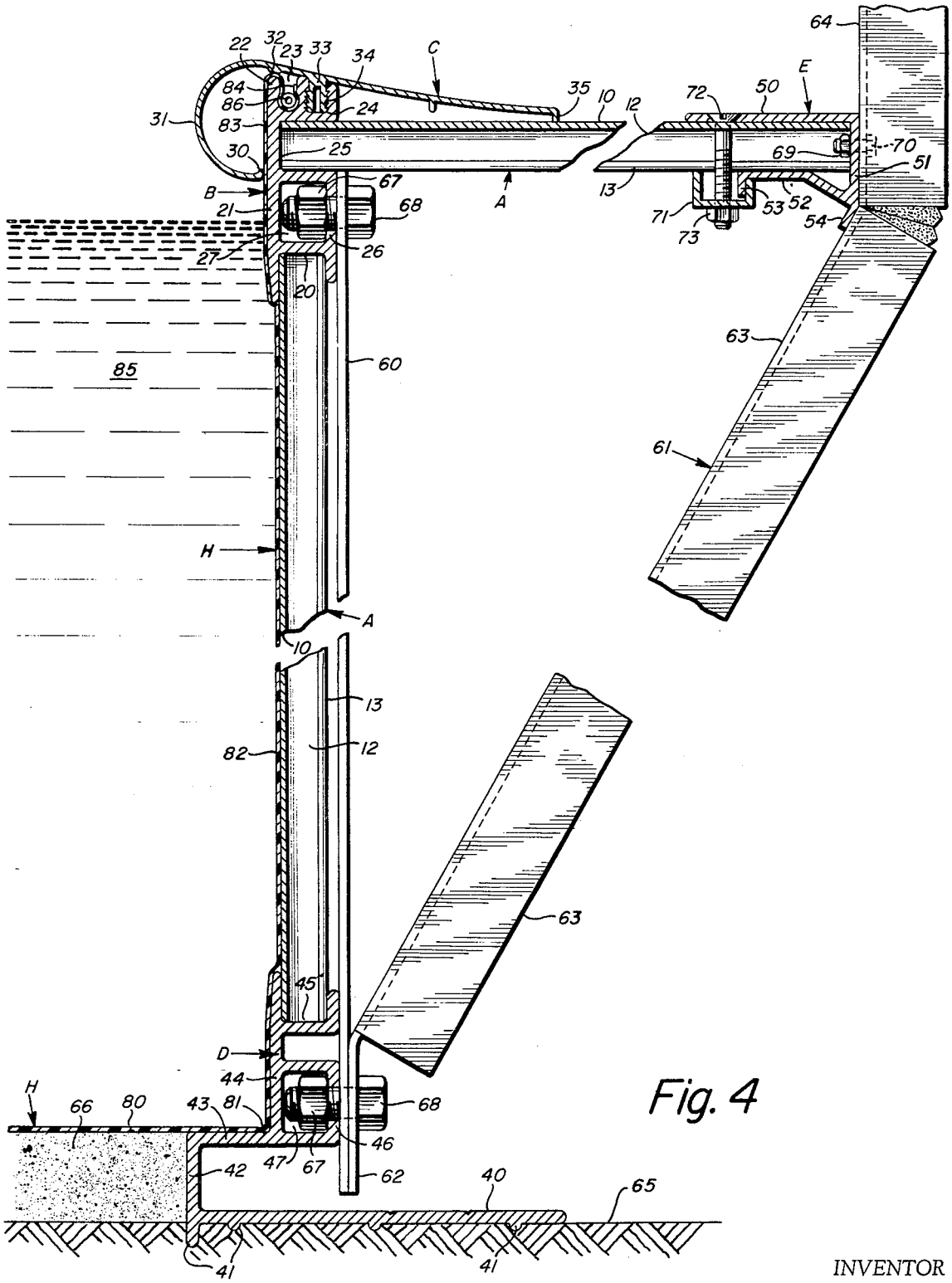
FIG. 4 represents a fragmentary section taken through the wall of the pool shown in FIG. 3.

Fundamental to an understanding of the invention is a consideration of the nature and characteristics of the metal wall boards, generally A, which are shown in detail in FIGS. 1 and 2.

Each of these boards is provided with a flat face 10 and is reinforced with a plurality of ribs, generally 11, each comprising a web 12 and a flange 13. One longitudinal edge of each board is provided with an offset male tongue 14, including an arcuate leading face 15 and shoulders 16. The other edge of board A is provided with a female groove 17, contoured to receive tongue 14, and including opposed returns 18—defining an opening 19 therebetween. Opening 19 is too small to permit entry of tongue 14 or to allow its withdrawl from groove 17.

Therefore, it is only possible to mount tongue 14 in groove 17 by longitudinal insertion, that is by sliding one into the other. Once this has been done, transverse forces cannot pull adjacent boards A apart because returns 18 serve as stops for shoulders 16. A linear run of wall has the recurring appearance of FIG. 1, no nuts, bols or other fasteners being required to hold the boards together. Further, the configuration shown permits a certain latitude in transverse dimensions allowing for expansion and contraction.

The boards, in addition to having these characteristics, have another characteristic which makes them a fundamental module in the embodiments described herein. Briefly, this characteristic is their ability to articulate with respect to each other. FIG. 2 shows such an assembly with tongue 14 pivoted within groove 17, pivotation being limited by returns 18, which serve as stops.

In practice, boards A are relatively narrow, on the order of 4 inches, and the design of the tongue and groove may be such as to permit an articulation of between 5° and 7°. With a 5° articulation per board, and 4 inches boards, a complete circle can be described with as few as 72 boards or approximately 24 running feet of perimeter. These same boards can be used to describe the perimeter of rectangular pools or of kidney-shaped and other free-form pools and are, consequently, fundamental to all embodiments of the invention and one of the key features thereof.

FIGS. 3 and 4 represent an above-ground embodiment of the invention having an integral deck, which is also made of boards A. In this embodiment, a coping beam, generally B, is provided which contains a first slot 20 on its underside to receive and retain the tops of vertically oriented boards A. This beam also includes an inner vertical transition face 21 and, on the top thereof, an upper lip 22, a first groove 23 and a second groove 24, which is provided with internal serrations 34. On its rear, it is provided with a second slot 25, and with a bolt-nut retention channel 26, having an opening 27.

Associated with the coping beam B is a coping trim piece, generally C, which has both ornamental and practical functions. This piece, which is preferably fabricated (as are all the parts so far discussed) as an extrusion, includes a forward edge 30, an arcuate intermediate portion 31, an internal snubber 32—adapted to juxtapose lip 22, a dependent split detent 33, and a trailing edge 35.

The bottoms of wall boards A are received in a ground-bearing beam, generally D, which may take several forms, various of which will be discussed in connection with FIGS. 5, 7 and 9. The one shown in FIGS. 3 and 4 is a continuous extrusion which includes a ground plate 40, preferably having a plurality of dependent cleats 41, a forward face 42, a shouldered return 43 and a vertical transition face 44. This face is preferably contoured, as is face 21, and is a mirror image therof. The balance of the beam construction is intentionally analogous to that of coping beam B and includes a first slot 45 to receive and retain the bottoms of boards A and a bolt-nut retention channel 46 having an opening 47.

The other major structural member utilized in this embodiment is an end cap beam, generally E. This beam, which is preferably a metal extrusion, includes a top plate 50, and end 51 and a contoured bottom plate 52 which terminates in a lip 53. The beam is also provided with an inturned flange 54 which is, in effect, a continuation of end 51.

Other pieces utilized for the assembly include a strap 60, which is used to connect beams B and D, and a brace, generally 61, which includes a flattened end 62, an intermediate channel portion 63 and a vertical portion 64.

The pool is erected on grade 65 by first leveling the site and then laying out the ground beam D to describe the perimeter. Corners may be butted, mitred or provided with special corner sections. Final internal level is achieved with fine aggregate or sand which is leveled off to approximately the height of return 43. The return itself can be used as a guide for a screed to level the sand. Boards A are then mounted in slot 45 and their longitudinal interlocking may be done at that time, board by board. Coping beam B is then positioned on top of the boards with the boards being received in slot 20. A plurality of nuts 67 are positioned in retention channels 26 and 46, using bolts 68, straps 60 and ends 62 are connected as shown, for example, in FIG. 4. Additional boards A, which serve as decking are mounted in slot 25 and the other end is received by beam E, in the slot between plates 50 and 52. The beam may simply be slid into place or mounted on the distal end of the deck boards at the time their proximal ends are inserted in slot 25. Vertical strap portion 64 may be then secured to end 51 with a plurality of nuts 69 and bolts 70. The cap beam E may be secured to the deck plates in any suitable manner. For example, a generally U-shaped clip 71, one leg of which rests on flanges 13 and the other end of which hooks behind lip 53 may be used. The clip ends are preferably serrated. A preferred clip is that described in application Ser. No. 64,873 filed July 27, 1970. Compressive forces are applied to the clip to secure the connection, as with machine screw 72 and nut 73. Vertical brace portions 64 serve as fence posts for fencing along the outer perimeter of the deck. Tie rods may be used between beams B and E, under the deck.

The liner, generally H, is now ready for installation. This liner includes bottom 80, lower corner portion 81, intermediate wall portion 82, coping portion 83 and end portion 84. Unlike prior art liners, the liner utilized herein need have no welt at the end and can be drawn taut to compensate for field tolerances. The liner is spread out and filling with water 85 progresses until the liner configuration in corner 81 conforms to the countour of beam D. As filling proceeds, the liner is drawn taut so that portion 82 conforms to the face of boards A and portion 83 follows the configuration of transition face 21. The end portion of the liner 84 is pulled over lip 22 and positioned in groove 23. Thereupon a resilient spline 86 is pressed into the groove to retain the end of the liner. The spline can conveniently comprise flexible resilient plastic tubing. If any sag develops, the liner can be selectively tightened by removing a length of spline, pulling the liner taut and re-inserting the spline.

The final step in the assembly is to mount trim piece C on beam B by friction fitting the compressible (i.e. split) detent 33 into serrated groove 24. When this is done, there is cooperation between the liner H, trim piece C and beam B — to wit, the liner portion 84 is held between lip 22 and the snubber 32. Further, the lip radiuses the liner and prevents tearing. Also, edge 30 snubs the liner against face 21. Finally, arcuate portion 31, in addition to being decorative — shields the end of liner 84 from physical damage in an area where the possibility of such damage is greatest. Trim piece C also provides a smooth transition from the edge of the pool to the deck.

Pools built in this manner have great inherent strength since they incorporate a repetivitive triangular truss defined by vertical wall boards A, coping beam B, deck boards A, end cap beam E, braces 61 and ground bearing beam D. They may be round or rectangular. When rectangular shapes are desired with relatively sharp corners (as distinguished from the rounded corners obtainable from articulation of the boards and conforming bending of beams B and D) special sections may be used.

Figure 8:
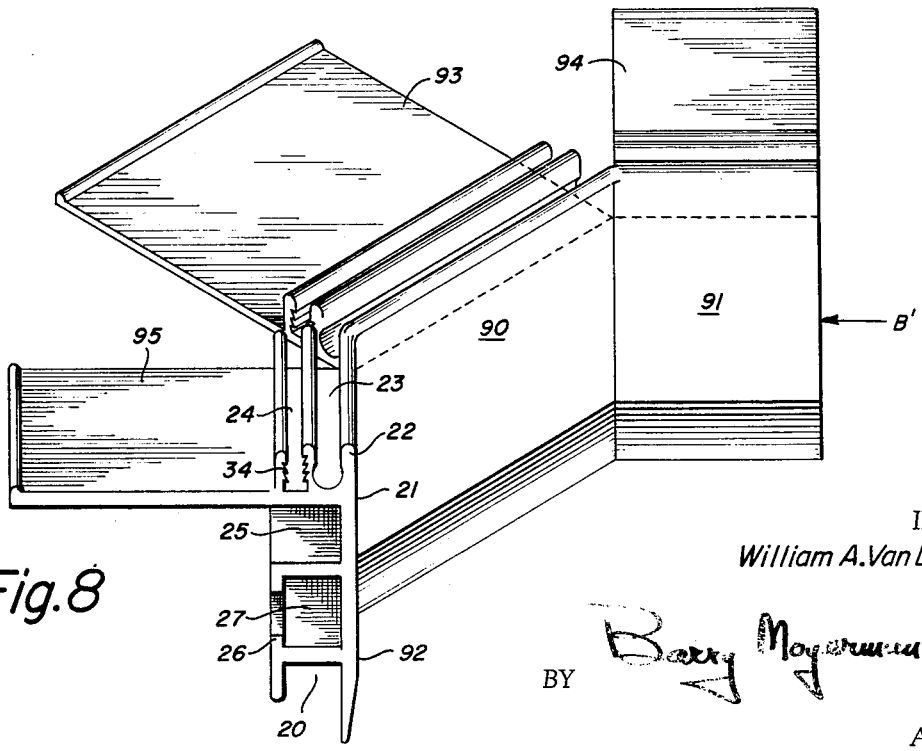
FIG. 8 is an isometric view of a corner beam section utilized in the corners of generally rectangular pools.

For example, FIG. 8 represents such a modification of the coping beam and will be designated generally therein as B′. The various grooves, slots and channels in this corner section are similar to those in beam B and have been so numbered in the drawing. This beam section is in tripanel form including center panel 90 and end panels 91 and 92. The included angles between panels are 45° so that the total assembly gives a 90° corner. Panels 90, 91 and 92 are provided with rearwardly extending cantilevered plates designated, respectively, 93, 94 and 95. Each panel is the width of a board A and the tongues 14 and grooves 17 of the boards used therewith are specially modified so as to be capable of 45° pivotation without loss of interlocking. Deck board A, as before, fit into slot 25 and their ends are shrouded by the rear plates which provide increased bearing surface and also act as fillers.

Figure 5:
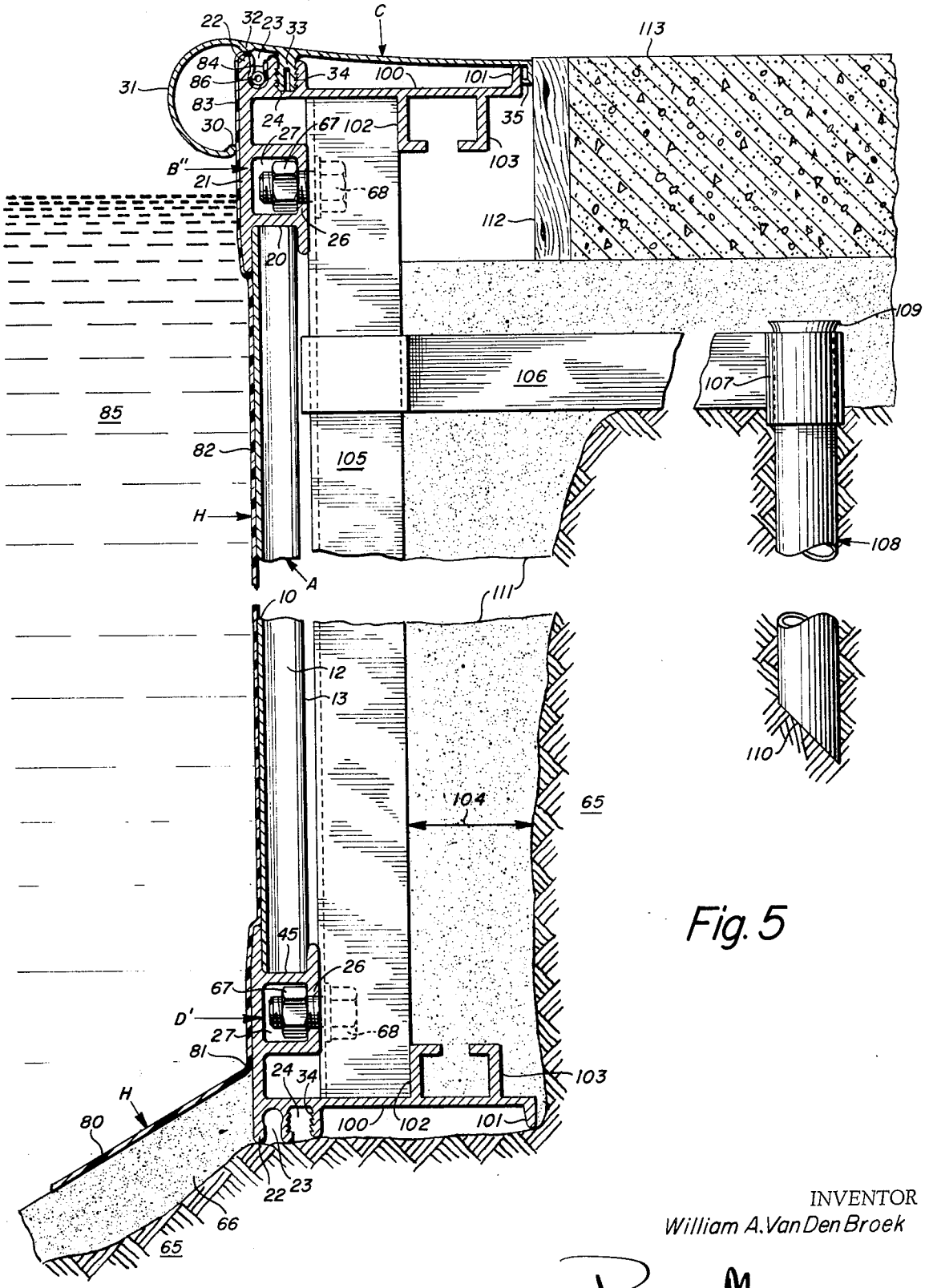
FIG. 5 represents a fragmentary section taken through the wall of an in-ground pool having straight sides and a concrete deck.

FIG. 5 represents as in-ground installation of a rectangular pool utilizing somewhat different components.

Beam D′ is somewhat different from beam D shown in FIGS. 3 and 4 and could have been used in the embodiment shown in those figures instead of beam D. Preliminary consideration of the figure will make the advantages of this construction immediately apparent. The same beam is capable of functioning as both a ground beam and a coping beam. While the latter has been designated B″ it is the same beam, made from the same extrusion, as beam D′. Beam B″ is not interchangeable with beam B in FIG. 4, however, because the latter is intended for use with an integral metal deck and is therefore provided with slot 25 into which the decking is received.

Like the previously discussed coping beam, beam B″ is provided with a transition face 21, an upper lip 22, a first groove 23, and a second groove 24 — having integral serrations 34. It also has a bolt-nut retention slot 26, provided with an opening 27. The beam is further provided with a rearwardly extending plate 100 terminating in an upturned lip 101 which parallesl lip 22. On the opposite side of plate 100 from lip 101, an auxiliary bolt-nut retention channel is provided having side walls 102 and 103. When the extrusion is used as coping beam B″, the function and operation of lip 22, groove 23 and groove 24 are the same as in beam B. However, then the extrusion is used as beam D′, these members serve as cleats.

As will become more apparent in connection with other embodiments, the construction shown in FIG. 5 permits in-ground installation of a pool with minimum expense. A cavity is excavated for the pool in ground 65 which is just a few inches larger than the perimeter described by lip 101. The dimension indicated in FIG. 5 as 104 would, for a 20 feet × 40 feet pool be on the order of 5 inches.

When the pool is assembled, boards A are mounted in the retention slot 45 of beam D′ and slot 20 of beam B″. The two beams are tied together with a plurality of vertical channels 105, which are secured to the beams with nuts 67 and bolts 68, the former being retained in channels 26. Channels 105 are dimentioned so that they are also wedged, top and bottom, between sidewall 102 and the face of retention channels 26, thus insuring total rigidity of structure. Proximate the top of channel 105 there is friction fitted or otherwise secured thereupon a cantilevered arm 106, which terminates in a socket 107. In this socket is mounted a tubular spike 108 having a flared top 109 and a chisel end 110. During assembly, spike 108 is driven into the ground, as shown in FIG. 5 and keeps the pool walls plumb. Thus, the reinforcing is achieved without the need for any extensive shoring below the top of the ground — such as would require extensive excavation. Before the installation of the liner, the excavation is backfilled with sand 111 and the top of spike 108 is also covered. The amount of backfill required is minimal compared to conventional in-ground installations. Typical lengths for arm 106, in pools as large as 21 inch × 41 inch (inside dimensions) are 41 inches. For a rectangular pool of this size, the excavation required at the bottom measures only 21 feet 10 inches × 41 feet 10 inches — sloping upward and outward to 22 feet 4 inches × 42 feet 4 inches at ground level. Following the backfilling, the liner is installed, as previously described, and coping trim piece C mounted on beam B″. Thereafter, a wooden stringer 112 is installed in perimetrical juxtaposition with trailing edge 35. A concrete deck 113 may then be poured. Where, as in FIG. 5, the floor of the pool is sloped, its contour may be determined by sandfill 66 and the liner laid accordingly.

Figure 6:
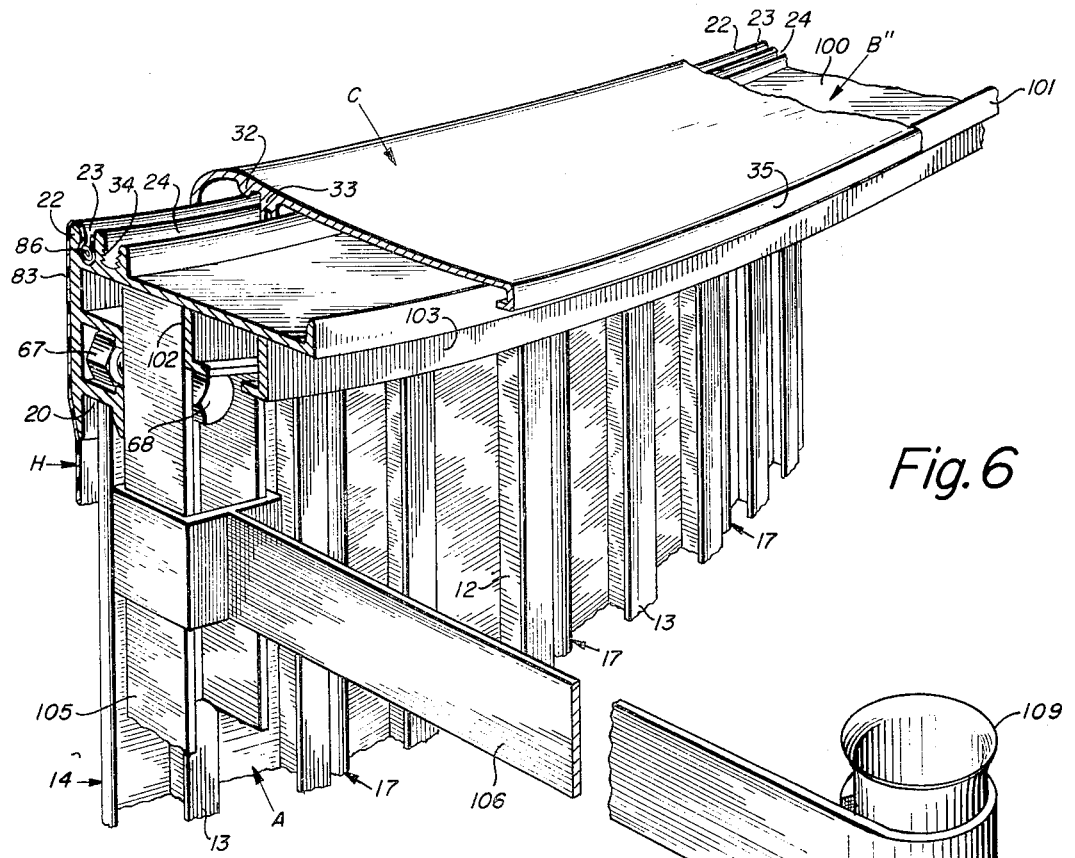
FIG. 6 represents a fragmentary perspective view of the upper portion of an in-ground pool having arcuate walls.

FIG. 6 is essentially a fragmentary perspective view of the upper portion of the pool of FIG. 5. However, beam B″ and trim piece C are arcuate, having been curved to provide an in-ground pool of the type shown in FIG. 9.

Figure 7:
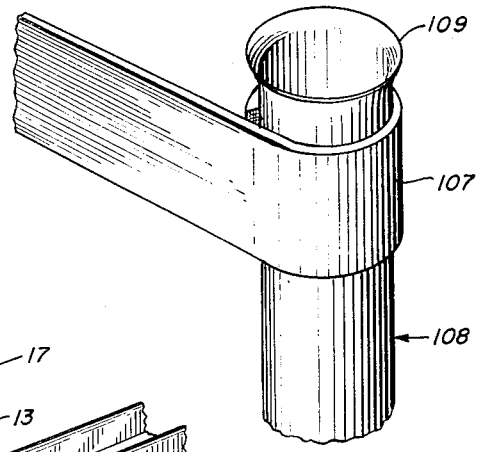
FIG. 7 represents a fragmentary perspective view of the ground bearing portion of the wall of a swimming pool which utilizes a two part beam.
Figure 7:
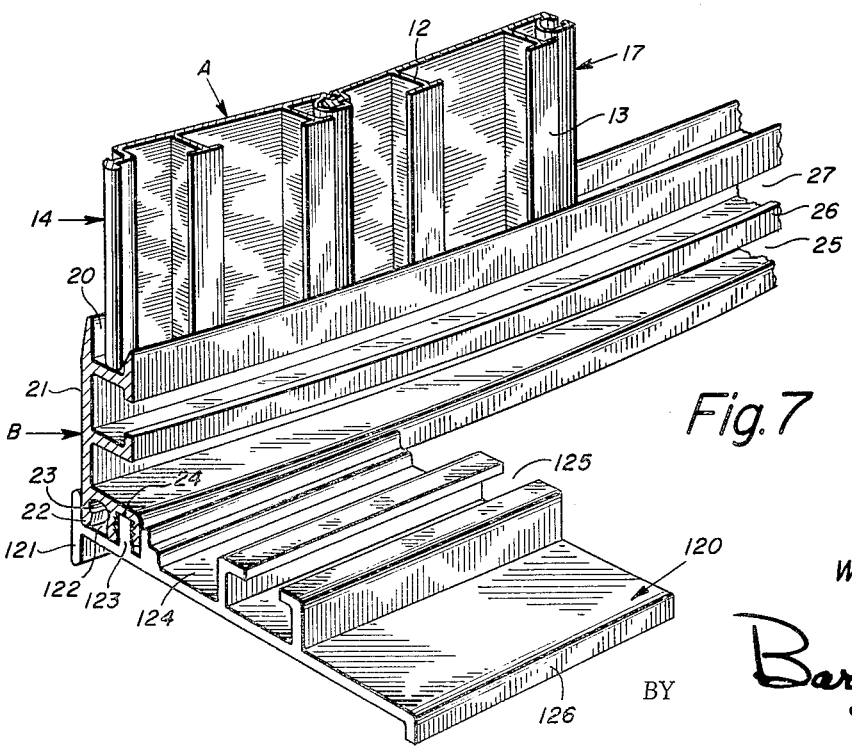

FIG. 7 is another fragmentary perspective view, this one being of the bottom portion of a pool and represents another form of ground bearing beam construction, which can be used instead of ground beam D (FIGS. 3 and 4) or D′ (FIG. 5) and is generally preferred for arcuate constructions. This assembly comprises a ground plate, generally 120, which includes a front flange 121, which projects upwardly to form a wall of a first slot 122 and downwardly to form a cleat. It is also provided with a lip 123, a second slot 124, a nut-bolt retention groove 125 and a terminal cleat 126. Mounted on this plate is a beam B, which is the same extrusion which, in FIG. 3, served as a coping beam. Consequently with this assembly, the same extrusion can be used both top and bottom, merely by inversion. Beam B mounts in slot 122 with lip 123 entering and being retained in groove 24. Slot 124 is utilized for mounting of channels 105 in a manner similar to that shown in FIG. 5.

Figure 9:
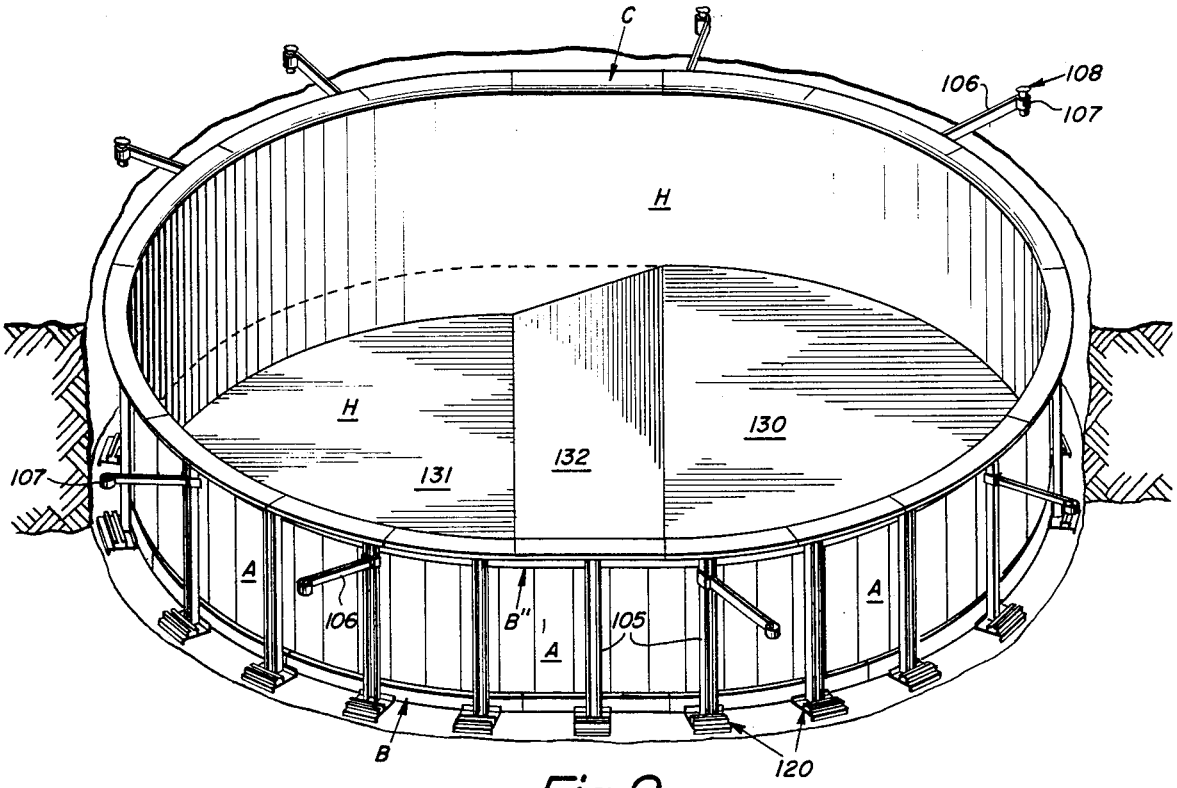
FIG. 9 represents an isometric view, partly cut-away, of a circular in-ground pool.

FIG. 9 shows a circular pool after erection and prior to backfilling and is presented more or less as a visual summary of the embodiments and variants heretofore discussed. This pool is provided with a shallow end 130, a deep end 131 and an intermediate sloped transition portion 132. It has been marked to indicate the previously discussed combinations and sub-combinations which are preferably used in such a construction. Note particularly the minimal excavation and backfilling required as well as the use of discontinuous ground plate 120. Rigidity is attributable to the boards A and the channels 105 and, of course, to the weight of earth following backfilling.

While the invention has been illustrated and described in detail, such description is not exhaustive of the possible variants and equivalents. Since it will be apparent to those skilled in the art that numerous changes and modificatios may be made, it is not intended that the invention be construed as limited to the specific embodiments discussed above. Rather, its scope is to be limited only by a reasonable interpretation of the appended claims.

I claim:

1. A modular swimming pool structure comprising:

a plurality of positively interlocked wall boards, each including a flat face and each extending vertically for the full depth of the pool to define the complete perimeter wall thereof, each of said boards having a male tongue on one longitudinal edge thereof, which is parallel to but offset from said flat face, said tongue terminating in a solid enlarged leading face, and a matching female groove on the other longitudinal edge thereof, which is coplanar with said tongue and includes opposed returns which prevent entry therebetween of said enlarged leading face, said tongue and groove being contoured to permit the flat faces of adjacent board to butt up against each other and also so that the male is slideably mounted in said female only by longitudinal insertion thereinto and said boards, when interlocked, being nonetheless transversely articulatable with respect to each other and in close abutting relationship with no gap between their faces in the vicinity of the tongue and groove joiner; and a water impermeable liner secured to the cavity whose sides are defined by the flat faces of said boards, said tongue and groove construction preventing the boards from pulling apart even when the pool is filled with water.

2. A modular swimming pool structure comprising:

a plurality of positively interlocked wall boards, each including a flat face and each extending vertically for the full depth of the pool to define the complete perimeter wall thereof, each of said boards having a male tongue on one longitudinal edge thereof, which is parallel to but offset from said flat face, said tongue terminating in a solid enlarged arcuate leading face, and a matching female groove on the other longitudinal edge thereof, which is coplanar with said tongue and has a generally U-shaped cross-section including opposed returns which prevent entry therebetween of said arcuate leading face, said tongue and groove being contoured to permit the flat faces of adjacent boards to butt up against each other and also so that the male is slideably mounted in said female only by longitudinal insertion thereinto and said boards, when interlocked, being nonetheless transversely articulatable with respect to each other and in close abutting relationship with no gap between their faces in the vicinity of the tongue and groove joinder; and a water impermeable liner secured to the cavity whose sides are defined by the flat faces of said boards, said tongue and groove construction preventing the boards from pulling apart even when the pool is filled with water.

3. The structure of claim 2 which further includes a coping beam having:

a. a first slot on the underside thereof which receives and retains the tops of said boards;

b. an inner vertical transition face, over which said liner is drawn taut;

c. a first groove on the top thereof which receives the end of said liner; and a resilient spline, mounted in said first groove and frictionally retained thereon, thus securing and retaining the end of said liner.

4. The structure of claim 3 wherein said coping beam further includes:

d. a lip intermediate said first groove and said transition face, over which lip said liner passes; and e. a second groove located proximate said first groove on the side of said second groove which is remote from the vertical wall boards;

said pool structure further including an arcuate coping trim piece, said piece having:

a. a leading edge which abuts said transition face to secure said liner against it;

b. an internal snubber in contact with said lip, which frictionally engages said liner; and c. a dependent detent, which is frictionally retained in said second groove to thereby mount said coping trim piece on said coping beam;

whereby said liner is protected from mechanical damage and additionally anchored against displacemnt.

5. The structure of claim 4 which further includes a ground beam, said beam including a groove for receiving and retaining the bottoms of said boards.

6. The structure of claim 5 which includes an integral deck, extending outwardly from the top of said pool about the perimeter thereof, said deck being assembled from boards identical in cross-section to those defining the cavity, one end of said board being received in said coping beam; an end cap beam positioned about the outer perimeter of said deck and receiving the other end of said boards; and a plurality of braces extending from said end cap beam to said ground beam.

7. The structure of claim 2 which further includes a coping beam having:

a. a first slot on the underside thereof to receive and retain the tops of said boards;

b. an inner vertical transition face, over which said liner is drawn taut;

c. a first groove on the top thereof for receiving both the end of said liner and a resilient, generally tubular spline which retains the liner therein; and d. means for receiving and retaining vertical channels.

8. The structure of claim 7 which further includes a plurality of vertically extending channels, the upper ends of which are retained in said coping beam.

9. The structure of claim 8 wherein means are provided on said channels, for keeping said wall boards plumb prior to back-filling of an excavation in which said structure is situated, said means comprising a cantilevered arm mounted proximate the top of the channel and extending outwardly, across the unfilled width of the excavation and terminating in a spike, said spike being supportively embedded in unexcavated ground.

10. The structure of claim 9 which further includes a ground beam, said beam including a groove for receiving and retaining the bottoms of said vertically extending channels and the bottoms of said boards.

11. The structure of claim 10 wherein the perimeter of said pool is arcuate and said ground beam is discontinuous.

* * * * *